US009383176B2

(12) United States Patent
Arguello et al.

(10) Patent No.: US 9,383,176 B2
(45) Date of Patent: Jul. 5, 2016

(54) SHAPED CHARGE ASSEMBLY SYSTEM

(71) Applicant: Schlumberger Technology Corporation, Sugar Land, TX (US)

(72) Inventors: Gerardo Arguello, Sugar Land, TX (US); Jason Mai, Houston, TX (US); Wenbo Yang, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 13/917,689

(22) Filed: Jun. 14, 2013

(65) Prior Publication Data

US 2014/0366763 A1 Dec. 18, 2014

(51) Int. Cl.
*F42B 1/028* (2006.01)
*F42B 1/036* (2006.01)

(52) U.S. Cl.
CPC ..... *F42B 1/028* (2013.01); *F42B 1/036* (2013.01)

(58) Field of Classification Search
CPC ..... E21B 43/116; E21B 43/117; F42B 1/02; F42B 1/024; F42B 1/028; F42B 1/032; F42B 1/036
USPC ..... 175/4.6; 102/306–310
See application file for complete search history.

(56) References Cited

U.S. PATENT DOCUMENTS 4,798,145 A 1/1989 McVeagh
6,386,109 B1 5/2002 Brooks et al.
6,386,296 B1 5/2002 Kothari et al.
6,520,258 B1 2/2003 Yang et al.
6,554,081 B1 4/2003 Brooks et al.
6,557,650 B2 5/2003 Fayard et al.
6,622,630 B2 9/2003 Yang et al.
6,896,059 B2 5/2005 Brooks et al.
6,945,116 B2 9/2005 Xie et al.
7,011,027 B2 * 3/2006 Reese et al. ..... 102/307
7,409,992 B2 8/2008 Zazovsky et al.
7,621,342 B2 11/2009 Walker
8,156,871 B2 4/2012 Behrmann et al.
8,166,882 B2 5/2012 Yang
8,226,782 B2 7/2012 Kneisl
8,342,094 B2 1/2013 Marya et al.
8,584,772 B2 11/2013 Yang et al.
2002/0129940 A1 9/2002 Yang et al.
2002/0162474 A1 11/2002 Pratt et al.
2003/0131749 A1 * 7/2003 Lussier ..... 102/306
2005/0247450 A1 * 11/2005 Ratanasirigulchai et al. 166/297
2006/0266551 A1 11/2006 Yang et al.
2010/0319562 A1 * 12/2010 Yang ..... 102/309
2011/0056362 A1 3/2011 Yang et al.
2011/0239888 A1 10/2011 Waddell et al.
2012/0027883 A1 2/2012 Walker
2012/0160492 A1 6/2012 Andrzejak et al.
2013/0056208 A1 * 3/2013 Xu ..... 166/298
2013/0087061 A1 4/2013 Marya et al.
2013/0340643 A1 12/2013 Yang et al.
2014/0060369 A1 * 3/2014 Mclean et al. ..... 102/310

* cited by examiner

*Primary Examiner* — Joshua Freeman

(57) ABSTRACT

A system where a group of substantially universal pre-manufactured explosive pellet assemblies are provided for on-site forming of shaped charges. That is, a specifically tailored liner may also be separately provided to the worksite/oilfield and combined with any one of the pellet assemblies so as to form a shaped charge having characteristics that are determined by the particular liner used. In this manner, hazardous shipping of fully assembled shaped charges may be avoided while at the same time allowing the operator a full range of shaped charge performance options based on the availability of uniquely tailored performance determinative liners that are also provided to the oilfield location.

4 Claims, 5 Drawing Sheets

SHAPED CHARGE ASSEMBLY SYSTEM

BACKGROUND

Exploring, drilling and completing hydrocarbon and other wells are generally complicated, time consuming and ultimately very expensive endeavors. As a result, over the years well architecture has become more sophisticated where appropriate in order to help enhance access to underground hydrocarbon reserves. For example, as opposed to wells of limited depth, it is not uncommon to find hydrocarbon wells exceeding 30,000 feet in depth. Furthermore, as opposed to remaining entirely vertical, today's hydrocarbon wells often include deviated or horizontal sections aimed at targeting particular underground reserves.

While such well depths and architecture may increase the likelihood of accessing underground hydrocarbon reservoirs, other challenges are presented in terms of well management and the maximization of hydrocarbon recovery from such wells. For example, during the life of a well, a variety of well access applications may be performed within the well with a host of different tools or measurement devices. However, providing downhole access to wells of such challenging architecture may require more than simply dropping a wireline into the well with the applicable tool located at the end thereof. Indeed, a variety of isolating, perforating and stimulating applications may be employed in conjunction with completions operations.

In the case of perforating, different zones of the well may be outfitted with packers and other hardware, in part for sake of zonal isolation. Thus, wireline or other conveyance may be directed to a given zone and a perforating gun employed to create perforation tunnels through the well casing. As a result, perforations may be formed into the surrounding formation, ultimately enhancing recovery therefrom.

The described manner of perforating requires first that the perforating gun be loaded with a number of shaped charges that provide the energy to form the noted perforation. Specifically, an explosive pellet of compressed material is provided in a casing and may be individually loaded into the gun as a shaped charge. Thus, once detonated, each shaped charge may perform similar to a ballistic jet in forming an adjacent perforation. Further, this manner of operation is enhanced by a liner that is placed over the explosive pellet. That is, the pellet is secured within the cavity of a casing and provided with a liner thereover so as to enhance and tailor the performance of the fully assembled shaped charge.

Unfortunately, while fairly safe and effective for use downhole in the well, providing the end user at the oilfield with a multitude of shaped charges may present a challenging and hazardous undertaking. For example, handling and transporting a conventional bulk explosive presents a certain level of inherent hazards. However, once the same materials are fully assembled and incorporated into a large number of shaped charges, the hazards increase dramatically. That is, unlike a single bulk supply of explosive, each and every shaped charge is individually enhanced with a liner and tailored for effective damaging detonation.

A variety of costly and time consuming efforts are generally undertaken in order to deal with the increased hazards presented by the handling and transport of shaped charges as noted above. This may include the use of specialized packaging such as transport carriers that are separately and uniquely tailored for accommodating each different type of shaped charge. The end result is that a variety of different sized and shaped carriers may be utilized in a given shipment. Once more, each carrier is separately housed within a thick barrier structure so as to account for the possibility of shaped charge detonation even in spite of the specialized carrier usage.

Setting aside the practical safety efforts that are generally taken as noted above, an added level of effort must also be dedicated to regulatory compliance. That is, not only is a significant amount of time and expense dedicated to ensuring safety, a significant amount of added delay is presented in the form of ensuring this compliance. So, for example, shipping of shaped charges generally is accompanied by time consuming paperwork and inspection.

Of course, all of the added effort is understandable given the hazards involved. Further, where an operator at an oilfield seeks to form perforations downhole, a viable alternative to a perforating gun loaded with shaped charges remains unavailable. Thus, as a practical matter, the effort, expense and delay presented to the shaped charge manufacturer and/or the end user remains largely unavoidable.

SUMMARY

A system for assembly of a shaped charge is provided. The system includes a pre-manufactured explosive pellet that is taken from a group of pellets which are all of substantially the same universal morphology and/or composition. A casing is provided for receiving the pellet along with a liner for completing the assembly. In contrast to the pellet, the liner is taken from a group of liners that are of substantially variable dimensions depending on predetermined characteristics of the shaped charge.

DETAILED DESCRIPTION

Embodiments are described with reference to certain downhole perforating applications in vertical cased well environments. In particular, wireline deployed applications utilizing a shaped charge assembly system are detailed. However, other forms of deployment and well architectures may take advantage of the shaped charge assembly system as detailed herein. For example, multi-zonal wells may benefit from such a system during stimulation operations. Regardless, so long as pre-manufactured explosive pellet assemblies are utilized with the system that are of substantially the same universal morphology and/or composition, significant benefit may be realized.

Figure 1A:
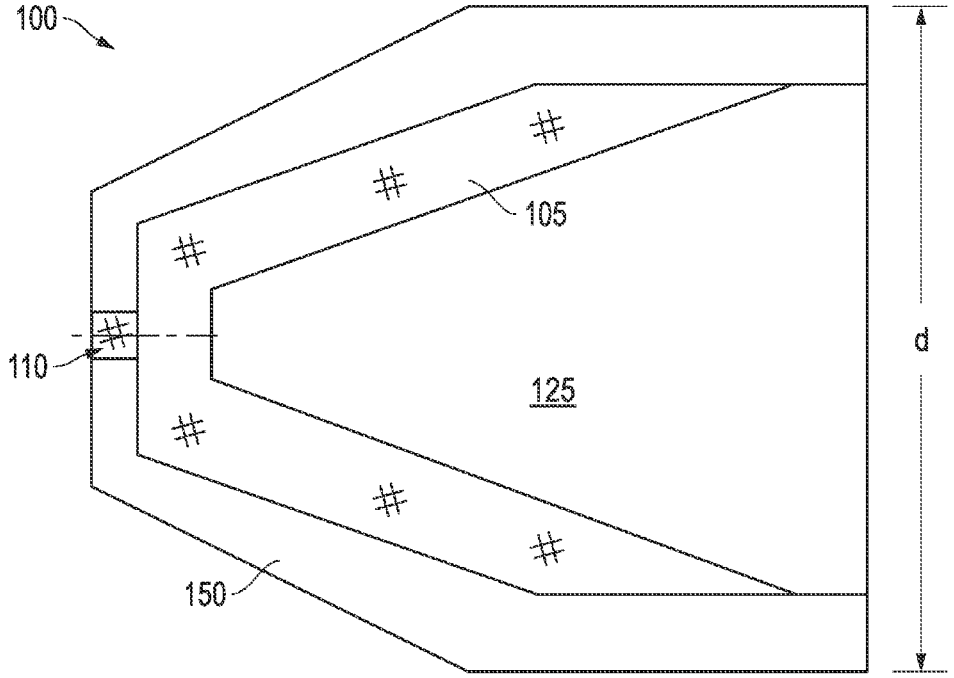
FIG. 1A is a side cross-sectional view of an embodiment of a pre-manufactured explosive pellet assembly.

Referring now to FIG. 1, a side cross-sectional view of an embodiment of a pre-manufactured explosive pellet assembly 100 is shown. The assembly 100 is itself a subassembly of a completed shaped charge 300 as shown in FIG. 3B. That is, in the embodiment of FIG. 1A, the assembly 100 remains unlined but includes a casing 150 with a pellet 105 exposed to a central void space 125. The pellet 105 serves as the explosive component for the assembly 100 such that it may later be utilized in perforating applications as detailed hereinbelow. The casing 150 on the other hand serves as 0.5-3.0 inch diameter (d) supportive shell for the assembly 100 (and later the completed shaped charge 300 of FIG. 3B).

The referenced pellet 105 is secured within the casing 150 as shown and interfaces with a fuse portion 110. So, for example, once the assembly 100 is later formed into a completed shaped charge 300, explosive perforating may be triggered (e.g. see FIG. 4A). The explosive pellet 105 may be of hexanitrostilbene, octogen, hexogen, pentaerythritol tetranitrate, or other suitable material so as to provide the energy for the noted perforating. Accordingly, the casing 150 may be of a suitable material to accommodate such explosive usage as well as preceding storage and transport. For example, durable steel, zinc, ceramic, glass and even plastics may be used in constructing the casing 150.

Figure 1B:
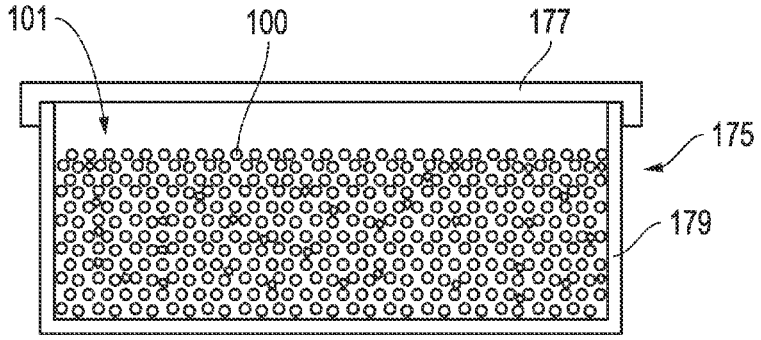
FIG. 1B is a side view of an embodiment of a container for storage of a plurality of substantially universal pre-manufactured explosive pellet assemblies.

Referring now to FIG. 1B, with continued added reference to FIG. 1A, a side view of an embodiment of a container 175 is shown for storage of a plurality of substantially universal pre-manufactured explosive pellet assemblies 101. That is, the assembly 100 of FIG. 1A may be but one of a plurality of pre-manufactured explosive pellet assemblies 101 that are each of substantially the same characteristics. For example, a variety of different dimensions, diameters (d), materials and other characteristics may be utilized for the assemblies 100, 101. Yet, in a specific embodiment as shown in FIG. 1B, each assembly 100, 101 of the plurality may be about 2.0 inches in diameter (d), utilize a steel casing 150 and accommodate a pressed powder of octogen material for the pellet 105. Indeed, the density, morphology and overall dimensions of the pellet 105 and casing 150 may also be substantially universal from assembly 100 to assembly 100 within the overall plurality 101.

A variety of advantages are available with a substantial universality of pre-manufactured assemblies 101 as described. For example, the assemblies 100 are unlined as indicated above. Thus, while explosive in nature, the potential for severe damage due to accidental detonation is negligible. This is due to the fact that effective jet inducing liners 310, 401, 401 are absent from the assemblies 101 (see FIGS. 4A-4C). As a result, the plurality of assemblies 101 may be transported in the container 175 with less concern over transportation hazards. This is particularly the case where the container 175 includes walls 179 and a lid 177 of sufficiently thick steel or other largely impenetrable construction. In fact, governmental regulations may recognize the the unlined or 'unloaded' nature of the assemblies 101, resulting in markedly lower importation taxes on shipping of such a container 175.

As detailed further below, the universal nature of the assemblies 101 also allows for on-site completion of shaped charges 300 as shown in FIG. 3B. For example, with added reference to FIGS. 4A-4C, any one assembly 100 may be pulled from the plurality 101 and tailored for a perforating application based on the type of liner 310, 401, 401 that is added. That is, since the assemblies 101 are substantially universal, the operator is able to personally tailor characteristics of the shaped charge 300, 400, 410, depending on the particular type of liner 310, 401, 402 he or she adds to each given assembly 100.

Figure 2:
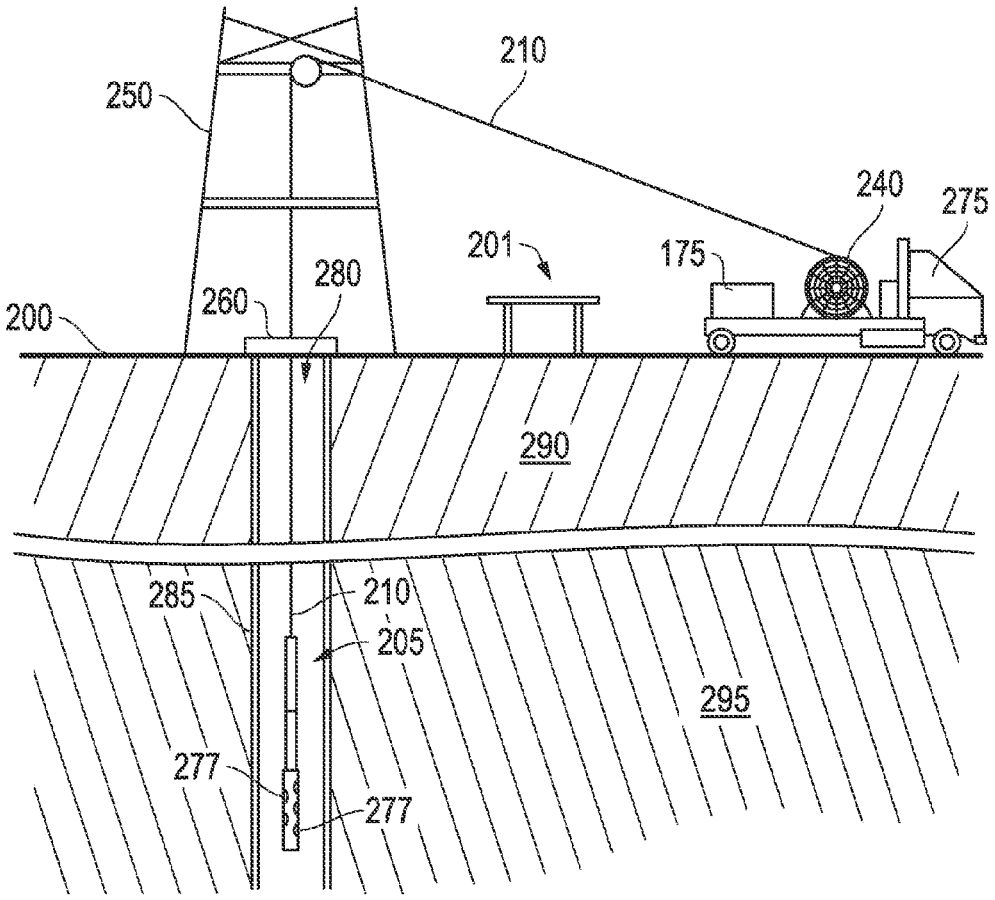
FIG. 2 is an overview depiction of an oilfield with a well for perforating by a gun employing assemblies taken from the container of FIG. 1B.

Continuing with reference to FIGS. 1B and 4A-4C, given that each assembly 100 of the plurality 101 may combine with any number of different liner types, the liners 310, 401, 402 themselves may be separately packaged, indexed and provided to a worksite as needed. This may be advantageous where the liners 310, 401, 402 are of a shorter shelf life than the plurality of assemblies 101. This is often the case due to the degrading nature of most powdered metal liners 310, 401, 402, particularly in humid conditions. However, a container 175 having a large number of assemblies 101 may be located longer term at worksite as shown in FIG. 2. Then, separately, fresh liner packages may be shipped to the worksite. Not only does this disassociation between the liner 310, 401, 402 and the rest of the shaped charge 300, 400, 410 address the shelf life issue, the separate liner shipping may avoid burdensome regulation. That is, where labeled and indexed packages of particular liner types are shipped without any underlying explosive material, no special regulatory shipping conditions are applicable. Rather, carefully packaged liners 310, 401, 402 may be shipped with the only unique constraints being those set by the manufacturer and/or customer.

With specific reference now to FIG. 2, an overview depiction of an oilfield 200 is shown with a well 280 for being perforated. That is, a perforating gun 205 is shown deployed into the well 280 via wireline 210 and traversing various formation layers 290, 295 before reaching a target location. The gun 205 is equipped with ports 277 that accommodate completed shaped charges 300 such as depicted in FIG. 3B. Thus, perforations 475, 477, 479 such as those shown in FIGS. 4A-4C may be formed in the casing 285 that defines the well 280.

Figure 3A:
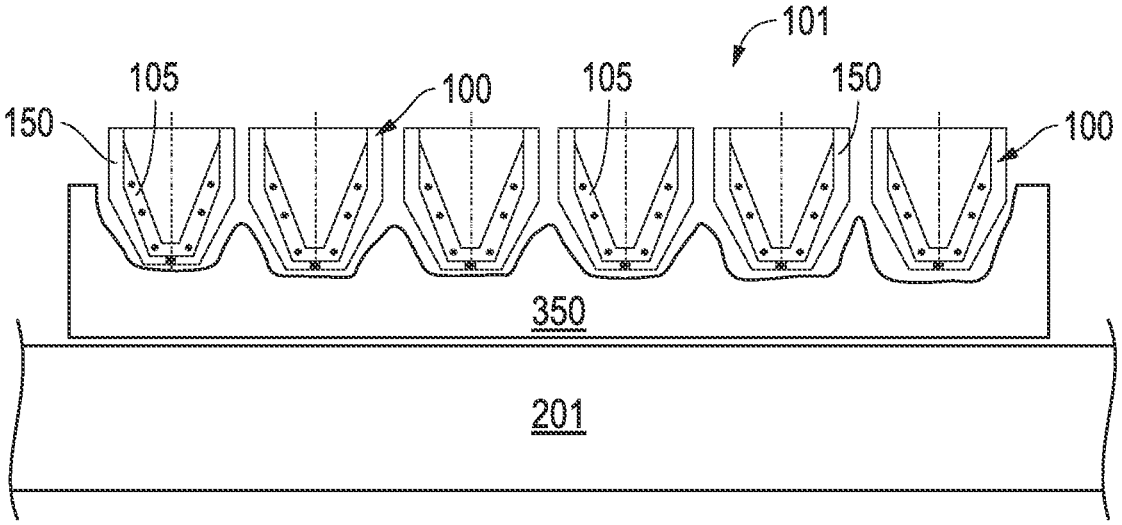
FIG. 3A is a side view of an embodiment of a support bin for organized placement of pellet assemblies located on a fabrication table of FIG. 2.
Figure 3B:
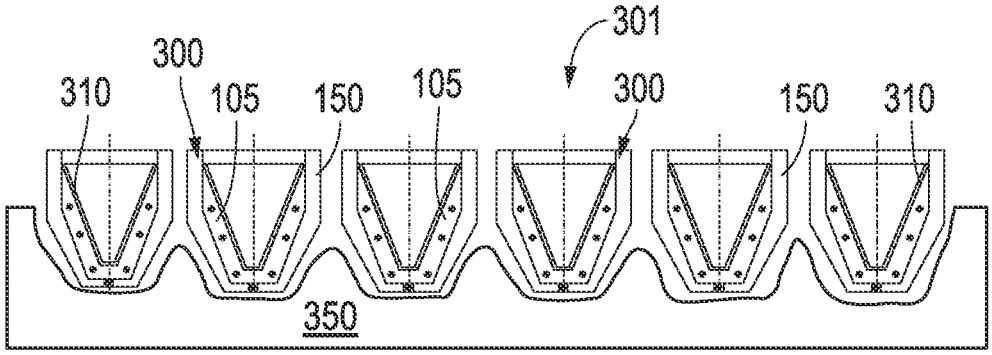
FIG. 3B is a side view of embodiments of completed shaped charges formed from adding tailored liners to the pellet assemblies of FIG. 3A.

With added reference to FIGS. 3A and 3B, the gun 205 is manually loaded with the shaped charges 300 once they are formed by the adding of liners 310 to universal assemblies 100, 101 taken from the container 175 at the worksite (also see FIG. 1B). Specifically, a fabrication table 201 is shown at the oilfield 200 where the liners 310, assemblies 100, 101 and perhaps even the gun 205 may be rested for sake of complete manual assembly as detailed further below.

With the gun 205 loaded and secured to a conveyance such as the depicted wireline 210, the reel 240 of a wireline truck 275 may be unwound. Thus, a rig 250 may support lowering of the gun 250 past a wellhead 260 and into the well 280 for a perforating application as noted above and detailed further below.

Referring now to FIG. 3A, with added reference to FIG. 2, a side view of an embodiment of a support bin 350 is shown. The bin 350 is located at the fabrication table 201 and used for organized placement of an array 101 of universal pellet assemblies 100. That is, as alluded to above, an operator at the oilfield 200 may remove several assemblies 100 from the container 175 for placement in the bin 350 as shown. The operator may inspect each assembly 100 for visual defects before placement. However, barring such issues, the operator need not be particularly selective about the placement since each of the assemblies 100 from the container 175 are substantially universal in terms of casing 150 and pellet 105 characteristics.

Referring now to FIG. 3B, another side view of the support bin 350 is shown. In this view, the bin 350 now accommodates a plurality 301 of completed shaped charges 300. That is, with added reference to FIG. 3A, each individual pre-manufactured universal pellet assembly 100 has been transformed into a completed shaped charge 300.

Each individually completed shaped charge 300 of the plurality 301 within the bin 350 of FIG. 3B is a result of individual placement of a tailored liner 310 into each of the pellet assemblies 100 of FIG. 3A. The liner 310 may be tailored so as to determine the ultimate performance characteristics of the shaped charges 300. For example, dimensions, density and overall architecture of the liner 310 may affect shaped charge performance. Additionally, material choices may play a role. In one embodiment, the liners 310 are of heavy metals. These may include tungsten, copper, lead and/or compressed powder mixtures thereof. Additionally, solid copper, aluminum or zinc may be utilized.

Continuing with reference to FIG. 3B, an operator at the oilfield 200 of FIG. 2 may unpack separate individual liners 310 of a desired type and begin manual placement thereof into each assembly 100 of FIG. 3A. The operator may even have a pressing tool or other implement available at the fabrication table 201 to aid in such placement. In the embodiment shown, the placed liners 310 are of a deep penetrating variety. That is, as detailed further below, each shaped charge 300 has been tailored by the type of liner 310 selected for 'deep penetration' in terms of a perforating application to take place downhole in the well 280 of FIG. 2. Of course, the same pre-manufactured assemblies 100 of FIG. 3A may be tailored into any number of different types of shaped charges 300, 400, 410 depending on the type of liner 310, 401, 402 selected (see FIGS. 4A-4C).

Figure 4A:
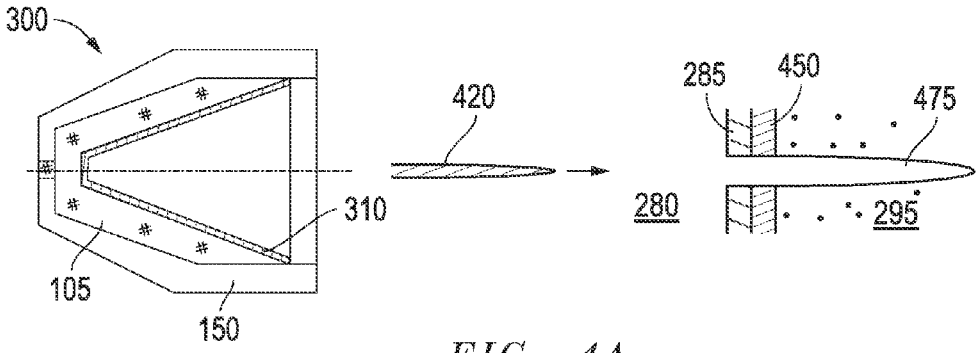
FIG. 4A is a side cross-sectional view of a deep penetrating jet shaped charge in use and formed from a pellet assembly of FIGS. 3A and 3B.
Figure 4B:
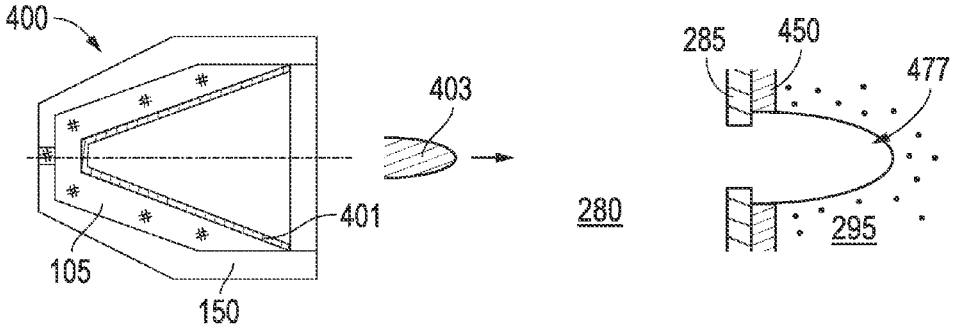
FIG. 4B is a side cross-sectional view of wide jet shaped charge in use and formed from a pellet assembly of FIGS. 3A and 3B.
Figure 4C:
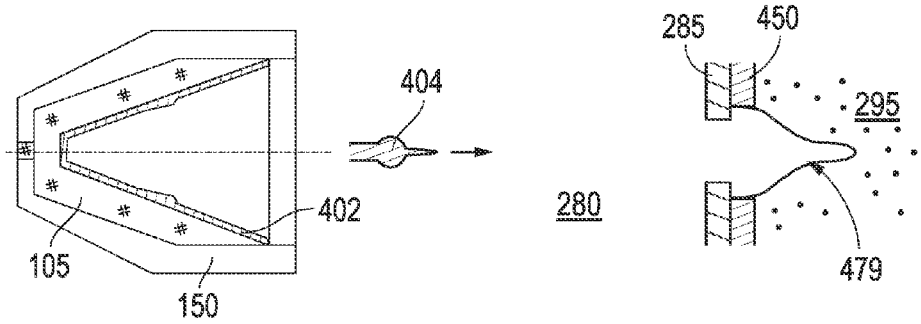
FIG. 4C is a side cross-sectional view of a combination jet shaped charge in use and formed from a pellet assembly of FIGS. 3A and 3B.

Referring specifically now to FIGS. 4A-4C, side cross-sectional views of a different types of shaped charges 300, 400, 410 in use during perforating applications are shown. That is, in each case, a charge 300, 400, 410 has been loaded into a perforating gun 205 such as that depicted in FIG. 2, and utilized in a perforating application in a well 280. The charges are made up of the same underlying universal pre-manufactured pellet assemblies 100 as shown in FIG. 1A with the same type of casing 150 and pellet 105. However, in each case, a different type of liner 310, 401, 402 has been used to provide a different type of charge 300, 400, 410 for a different type of perforating application.

With reference to FIG. 4A in particular, a deep penetrating jet shaped charge 300 is shown. Upon detonation, a deep penetrating jet 420 is formed and directed at the casing 285 that defines the well 280. Ultimately, this forms a perforation 475 that penetrates through the casing 285, cement 450 and into the adjacent formation 295 so as to aid in hydrocarbon recovery therefrom. In the embodiment shown, the liner 310 that is used to form the jet 420 and achieve such penetration may be a comparatively thin but high density tungsten-based liner 310 so as to form a thinner and longer jet 420. The end result, depending largely on the particular characteristics of the casing 285, may be a perforation 475 of between about 30 and 40 inches deep with a diameter of between about 0.3 inches and about 0.4 inches.

Of course, as depicted in the embodiment of FIG. 4B, a different type of liner 401 may be utilized to obtain a different type of charge 400 and performance during perforation. More specifically, in the embodiment of FIG. 4B a side cross-sectional view of wide jet shaped charge 400 is shown. In this case, the liner 401 is of a comparatively thicker dimensions and lower density, perhaps with a lower percentage of tungsten. Thus, a comparatively thicker or wider jet 403 may be formed. The end result, again depending on characteristics of the casing 285 and other physical factors, may be a shorter perforation 477 that is closer to 25-35 inches deep but with a wider diameter (e.g. between about 0.4 and about 0.5 inches).

Referring now to FIG. 4C, a side cross-sectional view of a combination jet shaped charge 410 is shown. In this case, the liner 402 may be of a thickness, density, materials and other characteristics similar to either of the deep penetrating 310 or wide 401 liner types described above. However, the combination liner 402 of FIG. 4C is of a uniquely tailored non-uniform morphology. Thus, a combination jet 404 may ultimately be formed such that the perforation 479 which is formed is also of a uniquely tailored morphology. Regardless, the same underlying universal pre-manufactured pellet assembly 100 as depicted in FIG. 1A provides the foundation for the charge 410.

Figure 5:
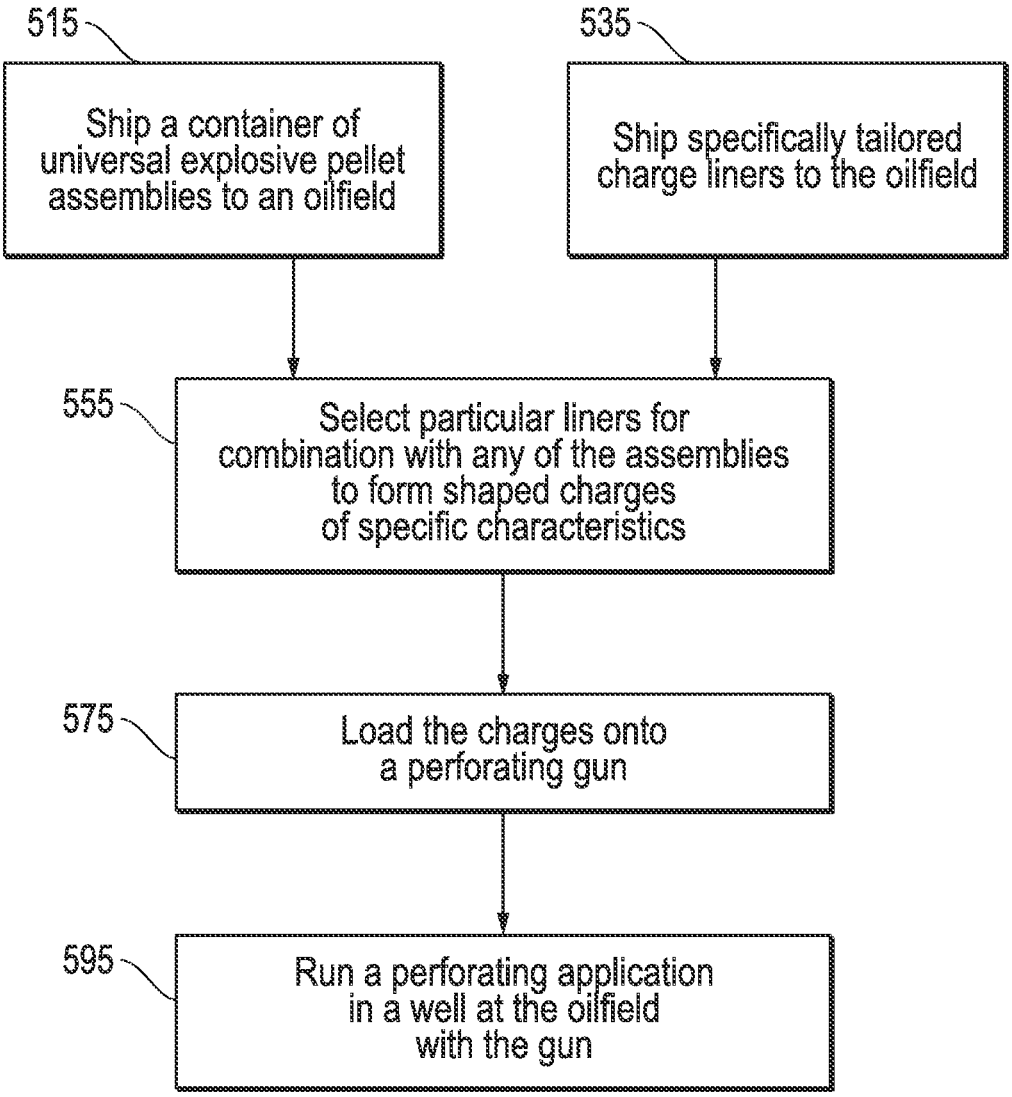
FIG. 5 is a flow-chart summarizing an embodiment of forming and utilizing shaped charges from substantially universal pre-manufactured pellet assemblies.

Referring now to FIG. 5, a flow-chart is shown summarizing an embodiment of forming and utilizing shaped charges from substantially universal pre-manufactured pellet assemblies. Namely, a container of the pellet assemblies may be shipped to the oilfield and stored thereat as indicated at 515. Separately, as noted at 535, specifically tailored liners may be sent to the oilfield. That is, a variety of different liner types may be sent to the oilfield.

With a host of different liner types available to the operator at the oilfield, particular liners may be selected for combination with any of the universal pellet assemblies. That is, as indicated at 555, completed shaped charges may be formed by selectively combination of unique liner types with generic universal pellet assemblies. With fully completed charges tailored by the operator's liner selections now available, a perforating gun may be loaded and utilized downhole as indicated at 575 and 595.

Embodiments described hereinabove include a practical manner of attaining effective and tailored shaped charges at an oilfield in a manner that addresses significant hazard and compliance issues in terms of shaped charge storage and transport. Namely, embodiments herein allow for the disassociation of shaped charge liners from the explosive pellet components. Thus, hazards associated with transport are dramatically reduced along with regulatory compliance hurdles. Once more, this is done in a fashion where the pellet components are provided to the oilfield as an array or plurality of substantially universal pre-manufactured assemblies. Thus, tailoring of shaped charge performance characteristics may be determined based on specially designed liners. This not only provides for a practical on-site mode of assembly but also addresses the fact that liners themselves are often of a shorter shelf life than the remainder of the shaped charge. As a result, shaped charges need not be discarded due to liner deterioration. Rather, fresher liners may simply be utilized at the time of on-site shaped charge assembly.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. A method of shaped charge assembly at an oilfield, the method comprising:

shipping a container of substantially universal pre-manufactured unlined explosive pellet assemblies to the oilfield; and selecting a specifically tailored charge liner from a group of substantially variable liners; and combining the selected liner with any one of the assemblies to form a shaped charge having performance characteristics determined by the selected liner.

2. The method of claim 1 further comprising delivering the liner to the oilfield in separate packaging after said shipping of the container of pellet assemblies.

3. The method of claim 1 further comprising:

loading a perforating gun at the oilfield with the shaped charge; and loading the gun with additional shaped charges formed from combining selected liners with universal pellet assemblies.

4. The method of claim 3 further comprising deploying the gun into a well at the oilfield for performing a perforating application therein.

* * * * *